United States Patent [19]

Dahlgren

[11] Patent Number: 4,589,480

[45] Date of Patent: May 20, 1986

[54] PLATE HEAT EXCHANGER

[75] Inventor: Arthur J. Dahlgren, Lund, Sweden

[73] Assignee: Alfa-Laval AB, Tumba, Sweden

[21] Appl. No.: 519,764

[22] PCT Filed: Dec. 9, 1982

[86] PCT No.: PCT/SE82/00421

§ 371 Date: Jul. 29, 1983

§ 102(e) Date: Jul. 29, 1983

[87] PCT Pub. No.: WO83/02157

PCT Pub. Date: Jun. 23, 1983

[30] Foreign Application Priority Data

Dec. 10, 1981 [SE] Sweden ..... 8107398

[51] Int. Cl.[4] ..... F28F 3/08; F28F 3/02; F28F 13/00

[52] U.S. Cl. ..... 165/146; 165/166; 165/167; 165/174

[58] Field of Search ..... 165/174, 166, 167, 146, 165/147, 175; 336/58

[56] References Cited

U.S. PATENT DOCUMENTS

| | | | |
|---|---|---|---|
| 2,554,185 | 5/1951 | Giegerich | 165/175 |
| 2,798,694 | 7/1957 | Sullivan | 165/166 |
| 2,838,288 | 6/1958 | Stoelting et al. | 165/109 R |
| 3,196,937 | 7/1965 | Jenssen | 165/166 |
| 3,908,758 | 9/1975 | Armonies et al. | 165/174 |
| 4,176,713 | 12/1979 | Fisher | 165/166 |
| 4,303,124 | 12/1981 | Hessari | 165/174 |

FOREIGN PATENT DOCUMENTS

| | | | |
|---|---|---|---|
| 0163069 | 6/1954 | Australia | 165/166 |
| 1501669 | 12/1969 | Fed. Rep. of Germany . | |
| 127970 | 4/1950 | Sweden | 165/166 |
| 372094 | 12/1974 | Sweden . | |
| 402485 | 7/1978 | Sweden . | |
| 417641 | 3/1981 | Sweden . | |
| 417458 | 3/1981 | Sweden . | |
| 0486757 | 5/1969 | Switzerland | 336/58 |
| 1412748 | 11/1975 | United Kingdom . | |

*Primary Examiner*—William R. Cline
*Assistant Examiner*—John K. Ford
*Attorney, Agent, or Firm*—Cyrus S. Hapgood

[57] ABSTRACT

Plate heat exchanger having mainly rectangular plates mounted in a frame. According to the invention the plates (6, 8) are arranged in at least two groups, the plates having port holes of one size being arranged in one group, while plates having port holes of another size are arranged in another group, the plate group having the largest port holes being arranged closest to the inlet (3) while a plate group having smaller port holes (9) is arranged further away from the inlet (3).

10 Claims, 7 Drawing Figures

PLATE HEAT EXCHANGER

Figure 1:
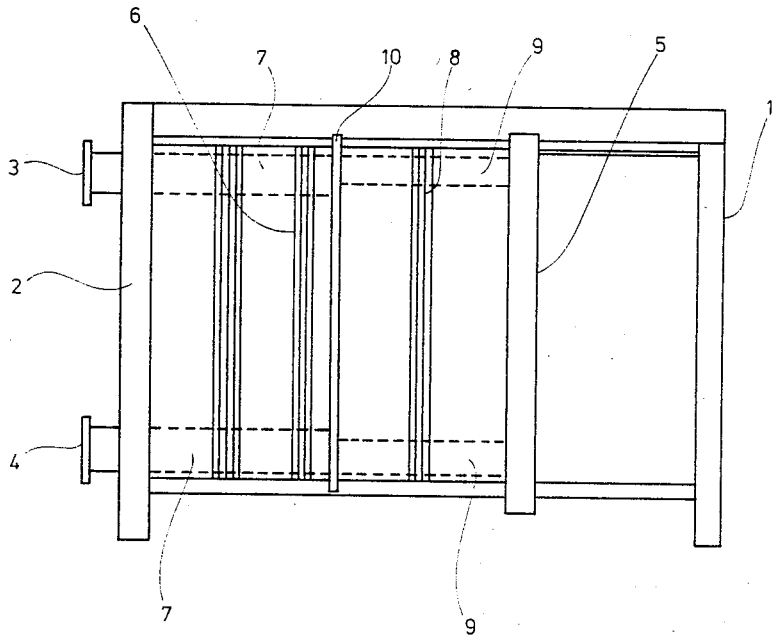

This invention relates to a heat exchanger comprising several plates mounted in a frame and mainly rectangular, which plates are tightened against each other and between which heat transfer areas in the form of heat exchanging passages are formed for through-flow of heat exchanging media, of which at least one is conducted to and from the heat exchanger via inlets and outlets arranged at one of its ends, the plates at their corner parts being provided with openings for forming of inlet and outlet channels.

Such plate heat exchangers are manufactured in different sizes having plates the heat transfer areas of which can range from some few square decimeters to several square meters. The plate material is chosen with regard to the field of use but usually comprises stainless or acid-resistant steel. For certain purposes titanium is used, which has excellent resistance against salt water but is very expensive.

Plate heat exchangers for large flows require inlet and outlet channels having large through-flow areas, i.e. large openings in the corner parts of the plates. That means that large parts of the plates have to be stamped away in order to get these large openings. Particularly in those cases when titanium is used that means that expensive material is stamped away.

In the inlet ports of the plates the flow is normally branched off for flowing through parallel-connected heat exchanging passages. Due to this fact the flow is reduced in size with the distance from the inlet. This fact means that seen from a theoretical point of view the port holes of the plates could be made smaller and smaller when the distance between the plates and the inlet becomes greater and greater.

If the port parts of the plates could be made smaller the useful heat transfer area could be made larger within the same raw sheet-metal size. In practice, however, it is not possible to arrange plates provided with port holes becoming smaller and smaller. Firstly, it would mean that it would be necessary for a plate heat exchanger supplier to have a very great number of plates in stock, which is not economically justifiable. Secondly, it would be necessary to have many expensive press tools.

Thus, there is a need in the market of a plate heat exchanger in which at least certain plates are provided with port-holes, which are smaller than those of the plates closest to the inlet. At the same time such a heat exchanger partly has to be economically justifiable, partly has to function satisfyingly.

By giving the heat exchanger such a design that is mentioned in the claims the existing needs can be filled.

According to a preferred embodiment the heat exchanger is provided with two groups of plates, the plates in one group having port holes mainly of one and the same size, while the plates in the second group have port holes of another size, which is mainly one and the same. The placing of the groups shall be such that the group of plates provided with the large port holes are placed closest to the connections of the frame plate. The groups are preferably separated by means of a separation plate arranged preferably by means of gaskets to tighten against the plates of respective groups.

Figure 2A:
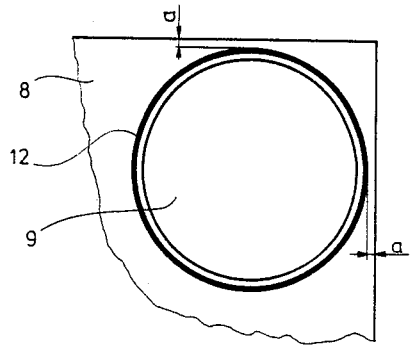
Figure 2B:
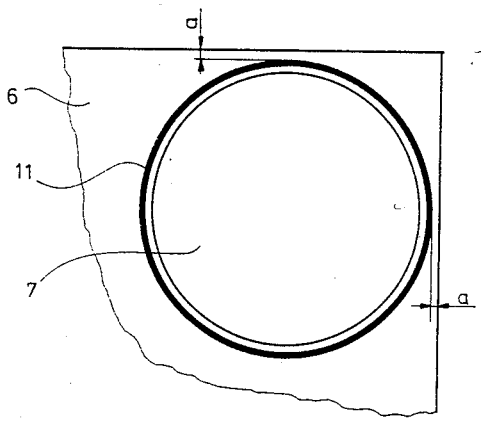
Figure 3:
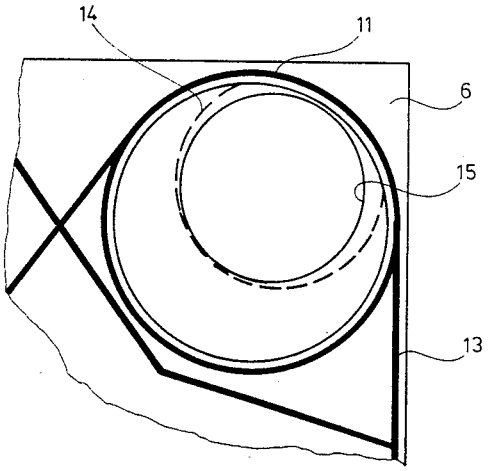
Figure 4A:
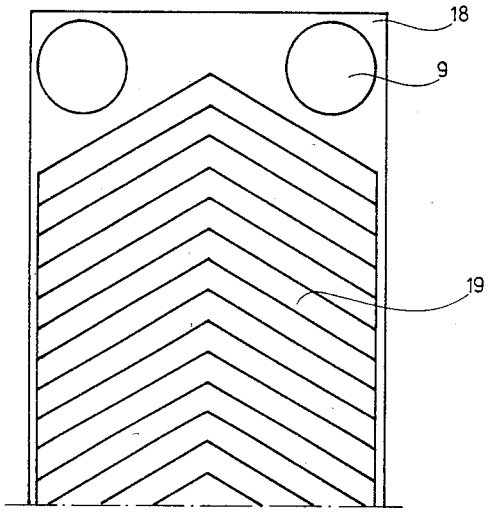
Figure 4B:
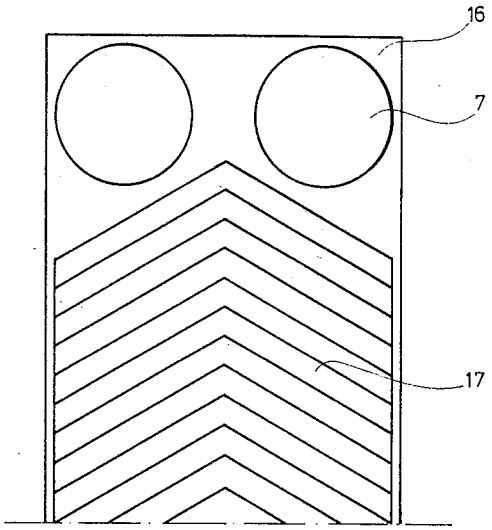
Figure 5:
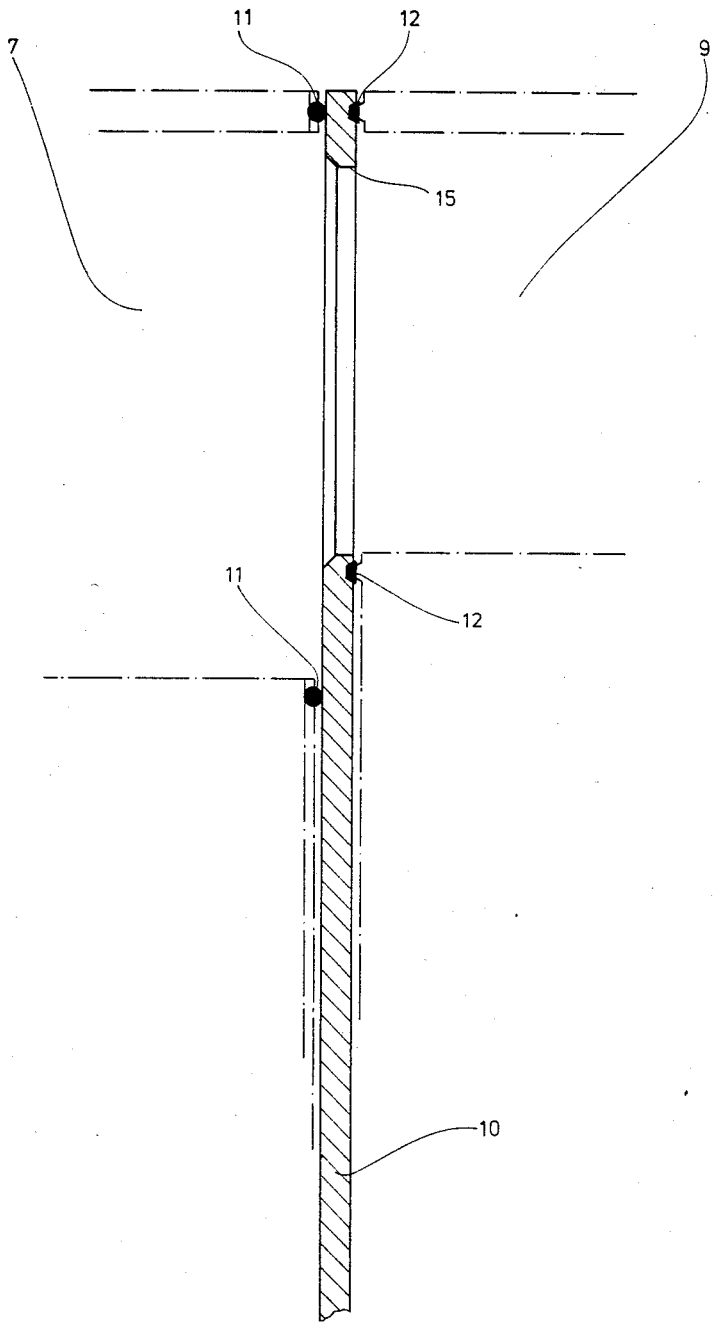

The invention shall in the following be described more in detail with reference to the accompanying Figures, of which FIG. 1 shows a side view of a heat exchanger according to the invention having two groups of plates;

FIGS. 2*a* and 2*b* show plan view of the corner parts of two plates having large and small openings, respectively;

FIG. 3 shows a plan view of the corner part of a plate having a large opening put on a separation plate with a plate having a smaller opening indicated beneath;

FIGS. 4*a* and 4*b* schematically show plan views of parts of plates having small and large openings, respectively, and corresponding heat transfer areas; and FIG. 5 shows a vertical, longitudinal section of a separation plate with plate groups having large and small openings, respectively, indicated in the corner parts.

In FIG. 1 is by 1 indicated a frame comprising a frame plate 2 having an inlet 3 and an outlet 4, and a pressure plate 5. In the frame partly a group of plates 6 having large openings 7 in the corner parts and partly a group of plates 8 having smaller openings 9 in the corner parts are mounted. The groups are separated by a separation plate 10.

The corner parts of the plates 6, 8 are shown in FIG. 2, the openings 7 and 9, respectively, being surrounded by ring gaskets 11, 12. The outer edge measure a outside the gaskets 11, 12 decide the position of the openings 7, 9 in the plates.

In FIG. 3 is shown that the openings 7, 9 in the corner parts of plates in two adjacent groups are not concentric since the position of the openings are decided by the outer edge measure a according to FIG. 2. In the Figure an edge gasket is indicated by 13. This one is connected with the mentioned gasket 11. The edge of the opening 9 is indicated by 14 and the edge of the opening of the separation plate by 15. This opening 15 has in the Figure for clarity reasons been made somewhat smaller than the opening 14 but is in reality mainly of the same size as is that one. The opening 15 is placed such that smallest possible flow resistance arises in the flow from the channel formed by the openings 7 to the channel formed by the openings 9, and vice versa, when the medium is flowing out of the heat exchanger. When the openings of a plate are small, the heat transfer area can be made large, i.e. a larger part of the plate is utilized, which is illustrated in the FIGS. 4*a* and 4*b*. In this connection the positions of the edge and the ring gaskets on the plate are changed which means that if the port holes are made small the position of the gasket is moved further upwards on the plate. This means that the plate gets a larger heat transfer area compared with the situation when the plate is provided with large port holes.

It is apparent from FIG. 5 how the gasket against the separation plate between two adjacent plate groups is arranged. The gasket 11 directly seals against the plane separation plate, while the gasket 12 engages a circular groove in the separation plate.

The invention is, of course, not limited to a heat exchanger having two groups of plates but three or more groups can be found. The essential thing is that the plates in each group are provided with port holes mainly of the same size.

Due to the great costs for manufacturing a new heat exchanger plate it is necessary from an economic point of view to use standard plates from already existing manufacturing programs when choosing plates having large and small openings, respectively. Thus, it is only necessary to manufacture a new separation plate in order to get a heat exchanger having optimum flowing and heat transfer characteristics.

In order to get a good economic effect the plates of the different plate groups shall be essentially different from each other regarding port size and therewith heat exchanger area while the outer dimensions are the same. Thus, the large port in two groups-heat exchangers ought to be at least 50% but not more than 100% larger than is the small port. Further, the number of plates having small ports ought to amount to at least the half of but not more than ⅔ of the total number of plates.

The total effect of the invention is then that a heat exchanger is provided which has the good economy of a heat exchanger having plates provided with small ports but having a capacity corresponding to the connection dimension of the large port in the plate group being closest to the inlet.

What is claimed is:

1. In a heat exchanger including a frame, a plurality of heat exchange plates mounted in the frame and having substantially the same rectangular shape and size, said plates being disposed in spaced face-to-face relationship and with pairs of adjacent plates sealed to each other to define a series of passages for separate flows of two heat exchanging media therethrough, the corner regions of the plates having openings defining inlet and outlet channels for conducting said media to and from the respective passages, the improvement comprising an inlet connection and an outlet connection for one of said media located at one end of the heat exchanger, said plates being arranged in a first group and a second group, said inlet connection communicating through said inlet channels for said one medium in said first group of plates with said inlet channels for said one medium in the second group of plates, said first and second groups having their said outlet channels for said one medium in communication with said outlet connection, said openings in the plates of the first group being of a first size for defining said inlet and outlet channels for said one medium, said openings in the plates of the second group being of a second size for defining said inlet and outlet channels for said one medium, said second size being substantially smaller than said first size, said openings in the plates of the second group being located eccentrically relative to the corresponding openings in the plates of the first group, each said eccentrically located opening being displaced toward at least one of the two adjacent plate edges from its location if it were concentric relative to the corresponding openings in the plates of the first group, whereby each plate of the second group has a substantially larger heat exchange area than each plate of the first group.

2. The improvement of claim 1, in which said first group is located nearer said one end of the heat exchanger than said second group.

3. The improvement of claim 1, comprising also gasket rings closely surrounding the openings of said first and second sizes, said openings being so located that the spacing between the outer diameter of each gasket ring and the adjacent plate edges is the same for the plates of said first and second groups.

4. In a heat exchanger including a frame, a plurality of heat exchange plates mounted in the frame and having substantially the same rectangular shape and size, said plates being disposed in spaced face-to-face relationship and with pairs of adjacent plates sealed to each other to define a series of passages for separate flows of two heat exchanging media therethrough, the corner regions of the plates having openings defining inlet and outlet channels for conducting said media to and from the respective passages, the improvement comprising inlet and outlet connections for at least one of said media located at one end of the heat exchanger, said plates being arranged in a first group and a second group, the plates of each group having their said inlet and outlet channels communicating with said inlet and outlet channels in the plates of the other group, said openings in the plates of the first group being of a first size for defining said inlet and outlet channels for said one medium, said openings in the plates of the second group being of a second size for defining said inlet and outlet channels for said one medium, said second size being substantially smaller than said first size, said openings in the plates of said second group being located eccentrically relative to the corresponding openings in the plates of the first group, each said eccentrically located opening being displaced toward at least one of the two adjacent plate edges from its location if it were concentric relative to the corresponding openings in the plates of the first group, whereby each plate of the second group has a substantially larger heat exchange area than each plate of said first group, said second group of plates having its said inlet and outlet channels for said one medium communicating with said inlet and outlet connections by way of corresponding channels in said first group of plates.

5. The improvement of claim 4, comprising also gasket rings closely surrounding the openings of said first and second sizes, said openings being so located that the spacing between the outer diameter of each gasket ring and the adjacent plate edges is the same for the plates of said first and second groups.

6. The improvement of claim 4, comprising also a separation plate separating said first and second groups from each other, and gasket rings sealing said groups against the separation plate.

7. The improvement of claim 5, comprising also a separation plate separating said first and second groups from each other, said gasket rings including rings sealing said groups against the separation plate.

8. The improvement of claim 4 or 5, in which the openings of said first size are at least 50% but not more than 100% larger than the openings of said second size.

9. The improvement of claim 4 or 5, in which the number of plates in said second group is at least ½ but not more than ⅔ of the total number of plates in the first and second groups.

10. The improvement of claim 9, in which the openings of said first size are at least 50% but not more than 100% larger than the openings of said second size.

* * * * *